US008476815B2

(12) United States Patent
Kato

(10) Patent No.: US 8,476,815 B2
(45) Date of Patent: Jul. 2, 2013

(54) SPARK PLUG AND MANUFACTURING METHOD THEREOF

(75) Inventor: Tomoaki Kato, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 662 days.

(21) Appl. No.: 12/452,691

(22) PCT Filed: Aug. 6, 2008

(86) PCT No.: PCT/JP2008/064090

§ 371 (c)(1),
(2), (4) Date: Jan. 27, 2010

(87) PCT Pub. No.: WO2009/020141

PCT Pub. Date: Feb. 12, 2009

(65) Prior Publication Data

US 2010/0133977 A1 Jun. 3, 2010

(30) Foreign Application Priority Data

Aug. 8, 2007 (JP) ..... 2007-206769

(51) Int. Cl.
*H01T 21/02* (2006.01)
*H01T 13/39* (2006.01)

(52) U.S. Cl.
USPC ..... 313/141; 445/7

(58) Field of Classification Search
USPC ..... 313/118–145; 445/7
See application file for complete search history.

(56) References Cited

U.S. PATENT DOCUMENTS

| | | | | |
|---|---|---|---|---|
| 5,144,188 | A | 9/1992 | Kagawa et al. | 313/11.5 |
| 6,166,480 | A * | 12/2000 | Ishida et al. | 313/141 |
| 6,307,307 | B1 | 10/2001 | Kanao | 313/142 |
| 6,373,172 | B1 | 4/2002 | Kanao et al. | 313/141 |
| 2003/0071552 | A1 | 4/2003 | Teramura et al. | 313/143 |
| 2006/0202599 | A1 | 9/2006 | Kato | 313/143 |

FOREIGN PATENT DOCUMENTS

| | | |
|---|---|---|
| JP | S58-182388 | 12/1983 |
| JP | H1-155293 | 10/1989 |
| JP | 4154069 | 5/1992 |
| JP | 2003-068420 | 3/2003 |
| JP | 2004-087464 | 3/2004 |
| JP | 2005050746 | 2/2005 |

OTHER PUBLICATIONS

International Search Report for International Application No. PCT/JP2008/064090, Oct. 7, 2008.

* cited by examiner

*Primary Examiner* — Anh Mai
*Assistant Examiner* — Zachary J Snyder
(74) *Attorney, Agent, or Firm* — Kusner & Jaffe

(57) ABSTRACT

A ground electrode and a metal shell are joined by welding or the like while an entire end face of a base of the ground electrode is brought into contact with a front end constituent face of the metal shell. The ground electrode has an extending portion extending forward in an axial (O) direction of the ground electrode. A front end portion faces a noble metal tip joined to a front end portion of the center electrode through a bending portion and forms a spark discharge gap (G) therebetween. A gap (a clearance) having a sufficient space to accommodate a virtual sphere (Q) with a radius of 1.2 mm is provided so that the virtual sphere (Q) being in contact with an inner face of the bending portion of the ground electrode is neither in contact with a center electrode nor an insulator.

7 Claims, 13 Drawing Sheets

SPARK PLUG AND MANUFACTURING METHOD THEREOF

FIELD OF THE INVENTION

The present invention relates to a spark plug for internal-combustion engines, the spark plug capable of preventing a side spark, and further relates to a method for manufacturing the same.

BACKGROUND OF THE INVENTION

A conventional spark plug is used for an ignition of internal-combustion engines, such as an automotive engine. The spark plug includes a center electrode, an insulator accommodating the center electrode in its axial bore, a metal shell surrounding and holding a radial circumference of the insulator, and a ground electrode having one end thereof that is joined to the metal shell and the other end thereof that forms a spark discharge gap with the center electrode. A spark discharge is conducted between the center electrode and the ground electrode to thereby ignite an air-fuel mixture.

Recently, automotive engines have been advanced with respect to high power and fuel efficiency, and a reduction in the size of a spark plug has been demanded in order to maintain freedom of design. In connection with this, a clearance between an outer circumferential face of the insulator and an inner circumferential face of the metal shell is reduced, whereby side sparks are caused by a lower potential difference than in a conventional case. In particular, an electric field tends to concentrate on an annular edge formed by a front end face and an inner circumferential face of the metal shell. Thus, a spark plug having miniaturized parts of the conventional spark plug is likely to cause side sparks in a region from the outer circumferential face of the insulator to the edge when carbon fouling occurs. In such a case, concentration of the electric field can be ameliorated if the annular edge formed by the front end face and the inner circumferential face of the metal shell is chamfered. As a result, side sparks are prevented. For example, see Japanese Patent Application Laid-Open (kokai) No. 2003-68420, hereinafter referred to as Patent Document 1.

However, when the spark plug is miniaturized, the metal shell is also reduced in thickness. When a certain area of the front end face of the metal shell, which effectively ameliorates the concentration of the electric field, is chamfered, a ratio of a flat area remaining in the front end face is smaller than that of the conventional spark plug. If an end face of the ground electrode is joined to this small flat area in the front end face, a contact area of the metal shell and the ground electrode is small whereby sufficient joint strength is unlikely to be obtained. Thus, it has been disclosed that a chamfered area of the front end face of the metal shell is further increased compared to the conventional spark plug so that an inclined face (joint face) formed by chamfering is wider. Then, the entire end face (joint end face) of the ground electrode (creeping face ground electrode) is brought into contact with the inclined face and joined thereto while the contact area therebetween is secured. For example, see Japanese Patent Application Laid-Open (kokai) No. 2005-50746, hereinafter referred to as Patent Document 2.

A normal ground electrode is formed in such a manner that a rod-like base material having a rectangular cross section is cut into a rectangular parallelepiped shape so that a sectioned face of the base material is perpendicular to an extending direction of the base material. Thus, when the ground electrode is simply joined to the inclined portion of the front end face of the metal shell, the front end side of the ground electrode inwardly extends and comes close to the front end portion of an insulator as a creeping ground electrode of Patent Document 2. As a result, side sparks tend to occur when carbon fouling arises. In such a case, as an aerial electrode disclosed in Patent Document 2, an end face of the electrode is preferably made into a slant face with respect to an extending direction so that the ground electrode extends in an axial direction of a spark plug when joined to the metal shell.

However, when bending a ground electrode to form a spark discharge gap, a portion of the ground electrode close to a joint face to the metal shell tends to start bending inwardly because the ground electrode is pressed against a mold so that an outer face thereof fits in the mold. Then, as in the above-mentioned creeping ground electrode, a portion from a bending part to the front end portion of the ground electrode inwardly extends in a slanted manner, whereby the flame kernel growing in the spark discharge gap is likely to be in contact with the ground electrode. As a result, it is likely to cause deterioration in ignitability. Further, since an inner face of the ground electrode comes close to a front end portion of the insulator, spark discharge tends to occur in a portion other than the spark discharge gap (i.e., side sparks) when a spark plug is fouled. In order to effectively prevent side sparks, a sufficiently sized gap (a clearance) surrounded by a face of the ground electrode facing the center electrode, the center electrode and the insulator is necessary.

The present invention is accomplished in order to solve the above-mentioned problems, and an object of the present invention is to provide a spark plug capable of securely preventing side sparks which are caused between the ground electrode, the center electrode and the insulator when the spark plug is fouled, and to provide a method for manufacturing the spark plug.

SUMMARY OF THE INVENTION

According to a first aspect of the invention, there is provided a spark plug, comprising: a center electrode extending in an axial direction; an insulator having an axial bore extending in the axial direction and holding the center electrode in the axial bore at a front end side; a cylindrical metal shell radially surrounding the insulator so as to hold the insulator and having a front end constituent face at a front end side opening thereof in which the front end constituent face comprised of a visible external surface when viewed from a front end side in the axial direction has a plurality of faces; and a ground electrode having one end joined to at least one of the plural faces that constitute the front end constituent face and other end bent toward an inner circumferential of the metal shell so as to form a spark discharge gap with a front end portion of the center electrode, the ground electrode further having an extending portion extending in the axial direction from the one end to the other end and a bending portion between the extending portion and the other end, wherein a virtual sphere is neither in contact with the center electrode nor the insulator, where the virtual sphere having a radius of 1.2 mm is assumed to be in contact with an inner face, which faces toward the center electrode, of the bending portion of the ground electrode, wherein, in the plural faces constituting the front end constituent face of the metal shell, a face adjoining at least a part of an inner circumferential face of the metal shell in the axial direction and constituting an inclined face where a diameter thereof increases from a rear end side to the front end side in the axial direction serves as a first face, and wherein, on an cross-sectional outline of the metal shell including the axis thereof, a length of the first face is the longest in that of the plural faces, which constitute the front end constituent face.

In the spark plug according to the first aspect, at least a part of the visible external surface viewed from the front end side of the metal shell is formed into the inclined first face. For example, the first face can be formed by chamfering an inner edge of an end face of the front end side opening of the metal shell. Concentration of an electric field tends to occur on the edge when no first face is formed. Thus, the first face can prevent such electric field concentration, resulting in the prevention of side sparks. When the end face of the front end side opening of the metal shell is chamfered, the inner circumferential edge is preferably chamfered in the circumferential direction. All edges (both inner and outer circumferential edges) of the end face at the front end side of the metal shell may be chamfered. Further, the end face may be ground so that an angle defined by the faces constituting the edge that is prone to be an origin of side sparks may be made wide. Alternatively, the edge may be estranged from the insulator in the radial direction by increasing the size of the chamfering face. Further, instead of chamfering the end face, the end face of the front end side opening of the metal shell may be formed into such a shape in advance.

Thus, although the thus-formed front end constituent face is constituted by the plural faces, the ground electrode may only be joined to at least one of the faces, and a predetermined distance (gap) may be maintained between the extending portion and the outer circumferential face of the insulator. Further, in the bending portion located between the extending portion and the other end, the sufficient gap (i.e., the clearance) to accommodate the virtual sphere having the radius of 1.2 mm and being in contact with the inner face of the ground electrode may be maintained so that the virtual sphere is neither in contact with the center electrode nor the insulator. Thus, the inclined face is formed by, for example, chamfering the front end constituent face so as to widen the angle defined by the faces that constitute the edge, which is prone to be the origin of side sparks. As a result, the concentration of electric field is reduced, whereby the side sparks can be prevented. Further, when the ground electrode, the insulator and the center electrode form the sufficient clearance therebetween, it is possible to reduce the side sparks generated in a portion other than the normal spark discharge gap. Furthermore, sufficient clearance can facilitate the growth of a flame kernel generated in the spark discharge gap to a sufficient size before reaching the ground electrode in a kernel growing process. Thus, the ignitability of the spark plug can be improved.

When the ground electrode is joined to the front end constituent face, the end portion of the ground electrode is likely to overlap the inclined first face. However, according to the first aspect of the invention, the length of the inclined first face on the cross-sectional outline of the metal shell is longer than that of other faces of the front end constituent face. That is, since the first face has an area larger than that of other faces and can provide a larger joint face, the joint between the ground electrode and the metal shell can be improved.

In the first aspect of this invention, the insulator may include: a cylindrical portion having an uniform outer diameter in the front end portion of the insulator; and an outer diameter transition part connected to the cylindrical portion at the rear end side with respect to the cylindrical portion in the axial direction and having an outer diameter that enlarges from the front end side toward the rear end side. Further, a second border is preferably positioned at the front end side with respect to a first border in the axial direction, where the first border serves as a border between the cylindrical portion of the insulator and the outer diameter transition part in the axial direction, and the second border serves as a border between the inner circumferential face of the metal shell and the first face.

The inner circumferential face of the metal shell is located closer to the outer circumferential face of the insulator rather than the front end constituent face in the radial direction. Since the inner circumferential face of the metal shell has a different plane direction from the first face adjacent thereto, the electric field tends to concentrate on the edge formed between the inner circumferential face of the metal shell and the first face. This edge is closest to the insulator in the radial direction among edges formed by the faces constituting the front end constituent face. As mentioned above, when the first border of the insulator is positioned at the rear end side with respect to the second border in the axial direction, the second border faces the cylindrical portion of the insulator in the radial direction. Since the cylindrical portion has a uniform outer diameter that is smaller than that of the outer diameter transition part, a distance between the cylindrical portion and the second border can be secured. As a result, the side sparks can be prevented.

In the first aspect of this invention, the virtual sphere may be in contact with the inner face of the bending portion at the front end side with respect to at least any one of the plural faces that constitute the front end constituent face of the metal shell in the axial direction in the state that the virtual sphere is neither in contact with the center electrode nor the insulator. When the virtual sphere is positioned at the front end side with respect to any face of the plural faces that constitute the front end constituent face of the metal shell, a flame kernel formed in the spark discharge gap is unlikely to be in contact with the ground electrode, the metal shell, and a wall of a combustion chamber during a flame kernel growth phase. Therefore, higher ignitability is achievable.

Further, according to the first aspect of the invention, a relationship: 120 degrees<=$\alpha$<=150 degrees may be satisfied, where "$\alpha$" is an angle formed by the inner circumferential face and the first face of the metal shell on a cross-sectional outline of the metal shell including the axis thereof. As mentioned above, the edge between the inner circumferential face and the first face of the metal shell is positioned at a closest position to the insulator in the radial direction. In order to prevent the side spark, the relationship: 120 degree<=$\alpha$ is preferable so as to avoid concentration of the electric field on the edge. Furthermore, as the $\alpha$ becomes greater, a width of the first face in the radial direction becomes small. When joining the ground electrode, the ground electrode is joined to the metal shell from the front end side in the axial direction because the ground electrode has the extending portion. Therefore, since a dimension of a portion of the ground electrode joining to the first face depends on the width of the first face in the radial direction, it becomes smaller as the angle $\alpha$ becomes greater. As a result, calorific capacity during a joint process is reduced, and a welding droop is likely to occur. Since the distance between the portion having a welding droop and the insulator tends to be shorter, it is likely to cause side sparks. Further, a welding droop tends to cause difficulty in maintaining the joint strength. In order to prevent these problems, the angle $\alpha$<=150 degrees is preferable.

According to the first aspect of the invention, the metal shell may include a second face as one of the plural faces constituting the front end constituent face, the second face comprised of a face perpendicular to the axis of the metal shell or an inclined face having a diameter reduced toward the front end side from the rear end side in the axial direction. That is, the front end constituent face of the metal shell according to the first aspect may include the face facing forward (front end side) in the axial direction or a face facing outward in the radial direction, as its second face.

According to a second aspect of the invention, a method for manufacturing a spark plug, comprises: an inclined face formation step for forming the front end constituent face in which at least a part of an end face of a front end side opening of a cylindrical metal shell intermediate body serving as an original form of the metal shell is chamfered in a circumferential direction so as to form a first face having a diameter that is enlarged toward the front end side from the rear end side in the axial direction, and a remaining external face of the front end portion of the metal shell intermediate body which is not chamfered serves as the second face; a joint face formation step for forming a first joint face and a second joint face that are to be joined together with the first face and the second face of the metal shell, respectively, in an end face of the one end of the ground electrode; an electrode joint step for joining the one end of the ground electrode to the front end constituent face of the metal shell intermediate body while the extending portion of the ground electrode extends along the axial direction of the cylindrical metal shell intermediate body that is serving as an original form of the metal shell; and a gap formation step for forming a spark discharge gap between the other end of the ground electrode and the front end portion of the center electrode by orientating the other end of the ground electrode toward the front end portion of the center electrode.

When the front end constituent face of the metal shell is formed into an inclined shape, a large gap between the metal shell and the ground electrode tends to be formed in a part of a contact area therebetween. This gap is likely to cause deterioration in joint strength. According to the second aspect of the invention, the end face of the one end of the ground electrode is ground in advance so as to correspond to the shape of the front end constituent face of the metal shell which assumes the slope shape. Then, when the ground electrode is joined to the metal shell, the entire end face of the one end of the ground electrode is brought into contact with the front end constituent face of the metal shell. Thereafter, they are joined together by welding or the like, resulting in obtaining the sufficient joint strength. The gap between the end face of the ground electrode and the front end constituent face of the metal shell is allowable as long as sufficient joint strength is maintained. Thus, the end face of the ground electrode is not necessarily joined entirely to the front end constituent face of the metal shell. That is, the end face of the ground electrode does not necessarily have the cutting angle exactly the same as the inclining angle of the front end constituent face of the metal shell in the joint face formation step. However, when the wide area of the end face of the ground electrode is brought into contact with the front end constituent face of the metal shell, higher joint strength can be obtained. Thus, it is preferable that the end face of the ground electrode be cut into the shape corresponding to the shape of the front end constituent face of the metal shell.

According to a third aspect of the invention, there is provided a method for manufacturing the spark plug, comprising: an electrode joint step for joining the one end of the ground electrode to an end face of the front end side opening of the metal shell intermediate body while the extending portion of the ground electrode extends along the axial direction of the cylindrical metal shell intermediate body that is serving as an original form of the metal shell; an inclined face formation step for forming the first face having an diameter that is enlarged toward the front end side from the rear end side in the axial direction by chamfering, in the circumferential direction, at least a part of the end face of the front end side opening of the metal shell intermediate body where the ground electrode is to be joined while avoiding a joint portion with the ground electrode; and a gap formation step for forming a spark discharge gap between the other end of the ground electrode and the front end portion of the center electrode by orientating the other end of the ground electrode toward the front end portion of the center electrode. In this way, the inclined first face may be formed in such a manner that the inner circumference edge of the front end face of the metal shell intermediate body is chamfered except for the joint portion to the ground electrode after joining the ground electrode to a front end side external surface of the front end portion of the metal shell intermediate body, which is serving as the original form of the metal shell. In this way, since the joint strength between the ground electrode and the metal shell is secured while securing the sufficient clearance therebetween, the ignitability of the spark plug can be improved, as well as preventing side sparks.

DETAILED DESCRIPTION OF THE INVENTION

First Embodiment

Figure 1:
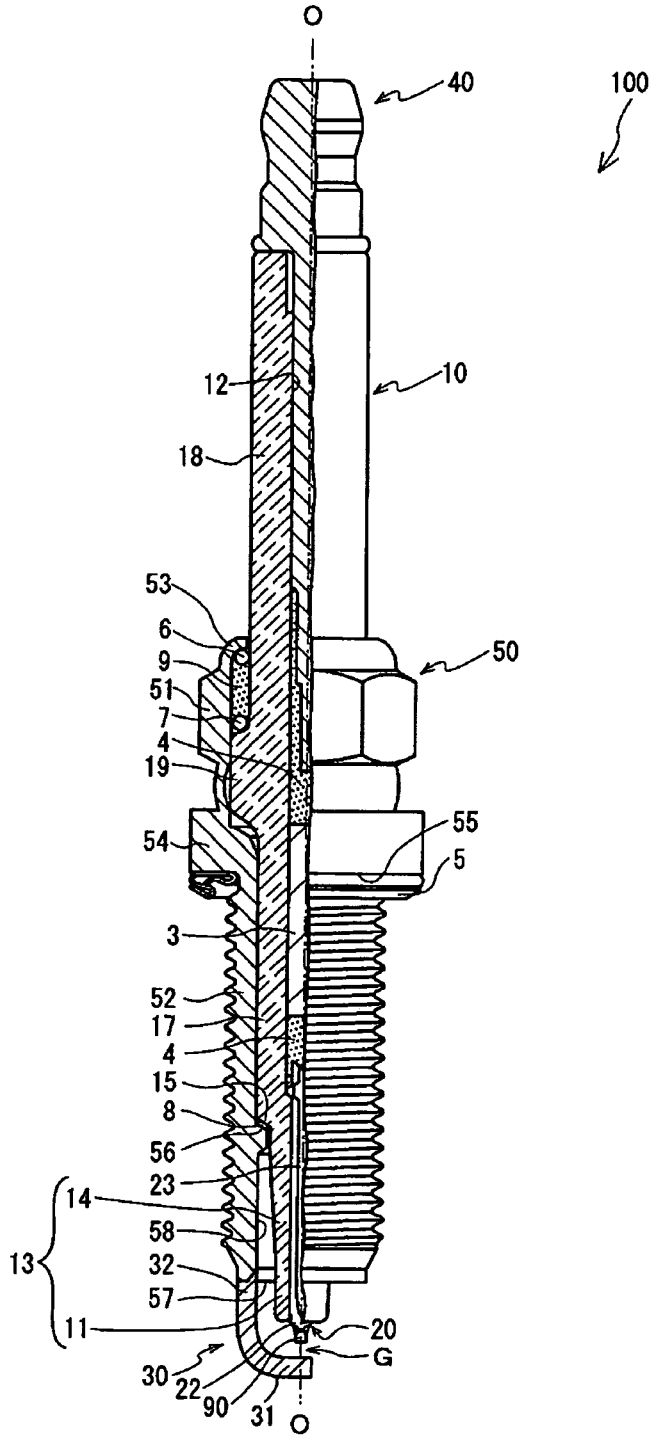
FIG. 1 is a partially sectioned view showing a spark plug 100 according to a first embodiment.
Figure 2:
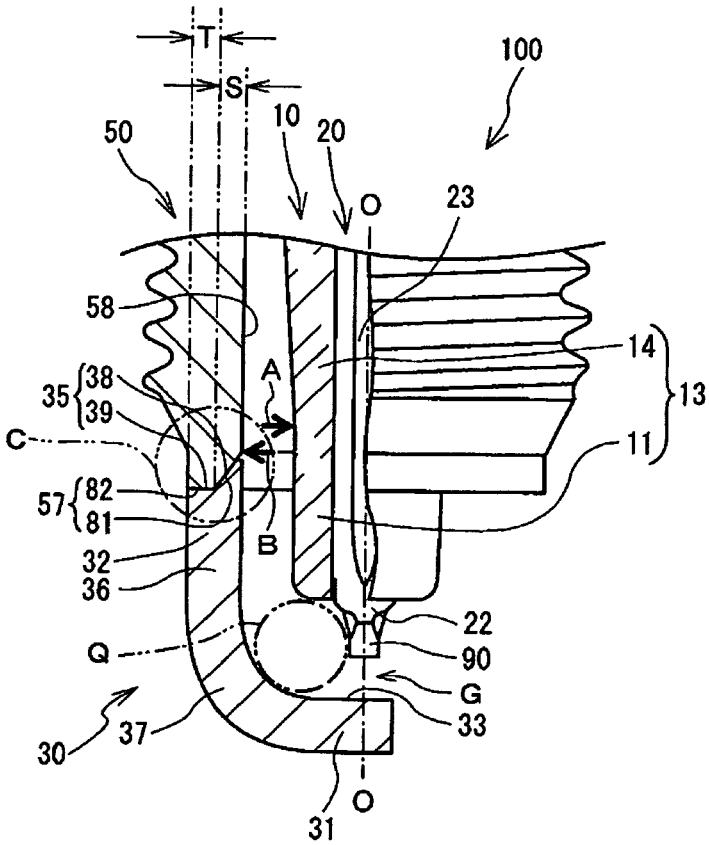
FIG. 2 is an enlarged relevant part sectional view showing a front end side of the spark plug 100.

Hereafter, a spark plug and a method for manufacturing the same according to an embodiment of the present invention will be described in detail with reference to the drawings. First, with reference to FIG. 1 and FIG. 2, a configuration of an entire spark plug 100 will be described as a first embodiment of the spark plug concerning this invention. In FIGS. 1 and 2, an axial O direction represents as a top-and-bottom direction in the drawings, and a lower side serves as a front end side and an upper side serves as a rear end side of the spark plug 100.

As shown in FIG. 1, the spark plug 100 is comprised of an the insulator 10 having an axial bore 12 in which a center electrode 20 and a terminal fitting 40 are accommodated, a cylindrical metal shell 50 holding therein the insulator 10, and a ground electrode 30 joined to a front end constituent face 57 of the metal shell 50 and forming a spark discharge gap G with the center electrode 20.

First, the insulator 10 will be described. The cylindrical insulator 10 is an insulating member made of sintered alumina or the like as is commonly known. The insulator includes therein the axial bore 12 extending in the axis "O" direction. A flange portion 19 having the largest outer diameter is formed in a general center of the insulator 10 in the axial "O" direction. A rear end side body portion 18 is formed on the rear end side with respect to the flange portion 19. A front end side body portion 17 having a smaller outer diameter than that of the rear end side body portion 18 is formed on the front end side with respect to the flange portion 19. Further, a front end portion 13 having a smaller outer diameter than that of the front end side body portion 17 is formed at the front end side with respect to the front end side body portion 17. The front end portion 13 has an uniform outer diameter at a base portion (a rear end portion) thereof, and a front end side with respect to the base portion is tapered toward the front end side (this tapered portion is hereinafter referred to as an "outer diameter transition part 14"). Further, near the front end of the front end portion 13, there is formed a cylindrical portion 11 connected to the outer diameter transition part 14 and having a uniform outer diameter. The front end portion 13 is exposed to a combustion chamber when the spark plug 100 is mounted on the engine head (not illustrated). In addition, a step portion 15 is formed between the outer diameter transition part 14 of the front end portion and the front end side body portion 17.

Next, the center electrode 20 will be described. The rod-like center electrode 20 is made of nickel-system alloy or the like, such as INCONEL (trade name) 600 or 601, in which a metal core 23 made of copper or the like and having excellent thermal conductivity is provided. The center electrode 20 is accommodated in the axial bore 12 of the insulator 10 at the front end side of the insulator 10. A front end portion 22 of the center electrode 20 projects from the cylindrical portion 11 of the front end portion 13 of the insulator 10 and is tapered off towards the front end side. As shown in FIG. 2, a columnar-shaped noble metal tip 90 made of noble metal, such as Pt, is welded to a front end face of the front end portion 22. The center electrode 20 has the noble metal tip 90 on the front end portion 22. When referring to the center electrode 20 in this embodiment, the noble metal tip 90 is included therein for the sake of convenience.

As shown in FIG. 1, the center electrode 20 is electrically connected to the terminal fitting 40 at the rear end side through a seal body 4 and a ceramic resistor 3 both of which are provided inside the axial bore 12. A high voltage cable (not illustrated) is connected to the terminal fitting 40 through a plug cap (not illustrated) in order to apply high voltage.

Next, the metal shell 50 will be described. The metal shell 50 is a cylindrical metal fitting for fixing the spark plug 100 to an engine head of an internal-combustion engine (not illustrated) and is made of iron system material. The metal shell 50 accommodates the insulator 10 therein so as to surround a region from the rear end side body portion 18 to the flange portion 19, the front end side body portion 17 and the front end portion 13 of the insulator 10. In this state, the cylindrical portion 11 of the front end portion 13 of the insulator 10 projects toward the front side with respect to the front end constituent face 57 of the metal shell 50 (lower side in FIG. 1). The annular front end constituent face 57 of the metal shell 50 faces forward and is chamfered so as to remove an inner circumference edge. The front end constituent face 57 is composed of a chamfered inclined portion 81 assuming an inclining shape and a flat portion 82 where no chamfering is conducted. In addition, the front end constituent face 57 is a visible face when a front end side opening of the metal shell 50 is viewed along the axial O direction from the forward (the front end side) in the axial O direction. Further, the metal shell 50 has a tool engagement portion 51 at the rear end side thereof for engaging with a spark plug wrench (not illustrated). Furthermore, a thread 52 is formed at the front end side of the metal shell 50 which is screwed into the engine head of the internal-combustion engine (not illustrated).

Further, annular ring members 6, 7 lie between the tool engagement portion 51 and the rear end side body portion 18 of the insulator 10. Furthermore, talc powder 9 is filled between the both ring members 6, 7. A caulking portion 53 is formed on the rear end side of the tool engagement portion 51. The caulking portion 53 is caulked so that the insulator 10 is pressed towards the front end side in the metal shell 50 through the ring members 6,7 and the talc 9. The metal shell 50 and the insulator 10 are united such that a step portion 56 supports the step portion 15 formed between the front end portion 13 and the front end side body portion 17 of the insulator 10 through a packing 8. The packing 8 secures the airtightness between the metal shell 50 and the insulator 10, thereby preventing combustion gas from flowing out. Further, a flange 54 is formed at the center of the metal shell 50 in the axis O direction, and a gasket 5 is provided near the rear end portion of the thread portion 52 (upper side in FIG. 1), i.e., on a seating face 55 of the flange 54.

Next, the ground electrode 30 will be described. The ground electrode 30 shown in FIG. 2 is made of a metal having an excellent corrosion resistance. As one of the examples, a nickel alloy, such as INCONEL (trade name) 600 or 601, is employed. The ground electrode 30 assumes a generally rectangular shape as seen from the cross-section in the longitudinal direction. An end face 35 of a base end 32 of the ground electrode 30 is welded to the front end constituent face 57 of the metal shell 50. An extending portion 36 extending along the axial O direction is formed at the front end side of the base end 32. A bending portion 37 adjoining the extending portion 36 is formed in the general center of the ground electrode 30 in the longitudinal direction and bent toward the axis O. A front end portion 31 adjoins the bending portion 37, and an inner face 33 inwardly faces the front end portion 22 of the center electrode 20 so as to form the spark discharge gap G therewith. As described above, the center electrode 20 has the noble metal tip 90 on the front end portion 22 thereof. More particularly, the spark discharge gap G is formed between the inner face 33 of the front end portion 31 and the metal tip 90 joined to the front end portion 22 of the center electrode 20.

Figure 3:
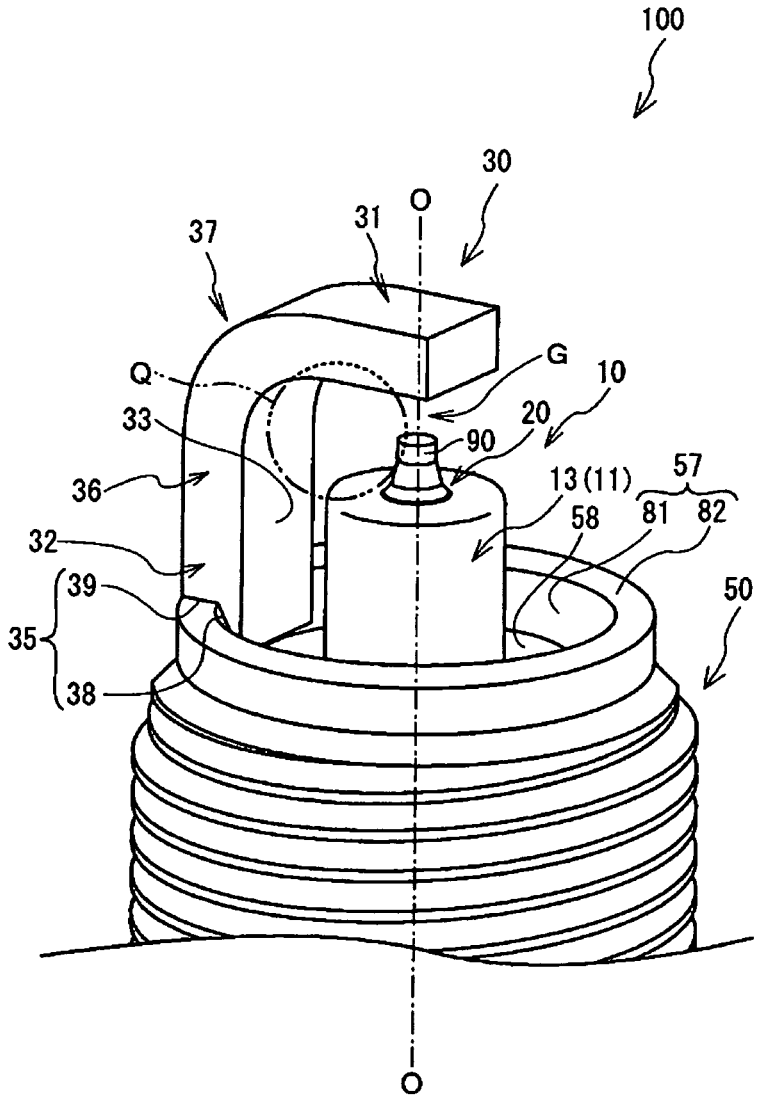
FIG. 3 is a perspective view showing a composition of the front end side of the spark plug 100.

According to the first embodiment, when the metal shell 50 is joined to the ground electrode 30, the end face 35 is processed so as to correspond to the shape of the front end constituent face 57. More particularly, as shown in FIGS. 2 and 3, in order to correspond to the front end constituent face 57 of the metal shell 50, the end face 35 of the ground electrode 30 is comprised of a corresponding inclined face 38 corresponding to the inclined face 81 and a corresponding flat face 39 corresponding to the flat face 82. Thus, before welding the ground electrode 30 to the metal shell 50, the entire end face 35 of the ground electrode 30 is brought into contact with the front end constituent face 57 of the metal shell 50. As a result, the entire end face 35 at the base 32 side of the ground electrode 30 adjoins the front end constituent face 57 of the metal shell 50 and a contact area therebetween is secured, thereby improving joint strength therebetween.

The flat face 82 and the corresponding flat face 39, and the inclined face 81 and the corresponding inclined face 38 may increase the contact area by conforming their shapes as much as possible in order to gain higher joint strength at the time of the joint. However, they are not necessarily exactly the same shape. That is, as long as the joint strength is sufficiently maintained after the joint, a very small gap is allowable therebetween. Therefore, in a joint face formation step that will be mentioned later, a cutting angle of the end face of the ground electrode does not necessarily exactly correspond to an inclined angle of the front end constituent face of the metal shell.

Further, when the inclined face 81 is formed in the metal shell 50, a new edge defined by an inner circumferential face 58 and the inclined face 81 is formed. Since an angle of this edge defined by the inner circumferential face 58 and the inclined face 81 is larger than an angle of an edge (before chamfering) defined by an end face 159 and an inner circumferential face 160 of a metal shell intermediate body 150 (which will be mentioned later (refer to FIG. 5)), concentration of electric field is prevented. According to the first embodiment, a position of the new edge is prescribed in order to assuredly prevent an occurrence of side sparks. As shown in FIG. 2, in the front end portion 13 of the insulator 10, a border between the cylindrical portion 11 and the outer diameter transition part 14 in the axial O direction serves as a border "A". A border between the inclined face 81 and the inner circumferential face of the metal shell 50 serves as a border "B". At this time, it is prescribed that the border A is at the rear end side with respect to the border B in the axial O direction. In other words, the border B is positioned so as to face the cylindrical portion 11 of the insulator 10 in a radial direction (i.e., a portion having a uniform outer diameter). Since the cylindrical portion 11 has the smallest outer diameter in the insulator 10, a radial distance between the cylindrical portion 11 and the border B is secured. Thus, it is possible to prevent a side spark caused by the concentration of electric field.

Figure 14:
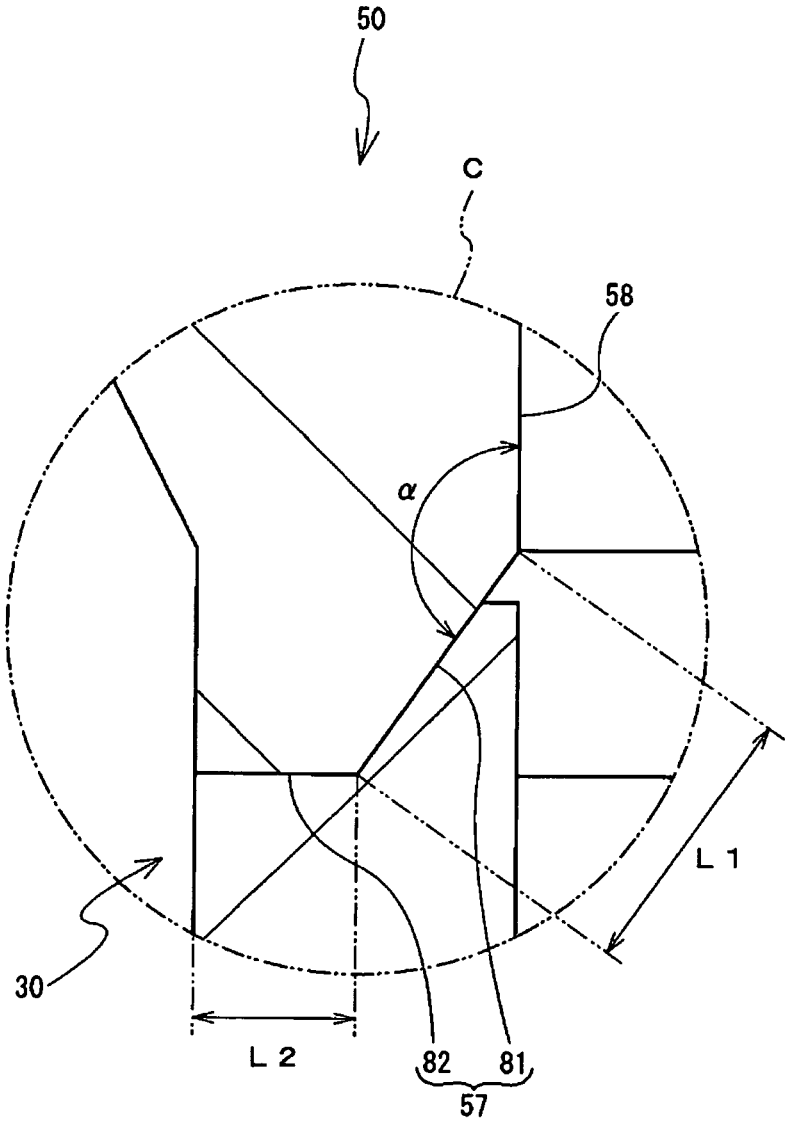
FIG. 14 is an enlarged view of a portion circled with a two-dot chain C in FIG. 2.

In the edge defined by the inner circumferential face 58 and the inclined face 81 of the metal shell 50, an angle of the edge which is formed by the inclined face 81 and the inner circumferential face 58 is prescribed in order to effectively prevent concentration of electric field. More particularly, as shown in FIG. 14, in the cross-section of the metal shell 50 including the axis O thereof, a relationship: 120 degrees<=$\alpha$<=150 degrees is satisfied, where "$\alpha$" is an angle formed by an outline of the inclined face 81 and an outline of the inner circumferential face 58. When the angle $\alpha$ formed by the outline of the inclined face 81 and the outline of the inner circumferential face 58 is smaller, electric field tends to concentrate, thereby causing a side spark. According to an example 4, which will be described later, the angle $\alpha$ is preferably 120 degrees or more in order to effectively prevent the concentration of electric field and the side sparks.

Further, as the angle $\alpha$ becomes larger, the width of the inclined face 81 in the radial direction becomes smaller. In the base 32 of the ground electrode 30, the corresponding inclined face 38 that corresponds to the inclined face 81 of the metal shell 50 also has the same tendency in that the size of corresponding inclined face 38 in the radial direction is insufficient as the angle $\alpha$ becomes larger, and thus at the time of joining the ground electrode 30 is unlikely to be secured to the metal shell 50. As a result, since thermal capacity at the time of joining becomes small, a welding droop is likely to occur. When a portion having the welding droop comes close to the cylindrical portion 11 of the insulator 10, side sparks are likely to occur. Further, when the welding droop arises, it is difficult to maintain the joint strength between the ground electrode 30 and the metal shell 50. In order to prevent this problem, the angle $\alpha$ is preferably 150 degrees or less according to the example 4, which will be mentioned later.

The first embodiment prescribes that a length L1 of the inclined face 81 on the outline of the metal shell 50 is longer than that of other faces (e.g., a length L2 of the flat face 82) constituting the front end constituent face 57 in the cross-section of the metal shell 50 including the axis O thereof. In this way, the inclined face 81 is securely formed, and a large area thereof is maintained.

The extending portion 36 extends from the base 32 of the ground electrode 30 towards the front end side in the axial O direction, and is disposed so as to keep a predetermined distance (a gap) to the outer circumferential face of the cylindrical portion 11 of the front end portion 13 of the insulator 10 in the radial direction. The bending portion 37 bent toward the front end portion 31 from the extending portion 36 is formed so that the inner face 33 of the ground electrode 30 does not come close to the cylindrical portion 11 of front end portion 13 of the insulator 10 and the front end portion 22 of the center electrode 20, thereby having a sufficient gap (i.e., a clearance) therebetween. More particularly, as shown in FIG. 2, in the bending portion 37 of the ground electrode 30, a virtual sphere Q having a radius of 1.2 mm (shown in a two-dot chain line in FIG. 2) is assumed. The virtual sphere Q being in contact with the inner face 33 is neither in contact with the center electrode 20 (including the noble metal tip 90) nor the insulator 10. That is, the inner face 33 of the bending portion 37 of the ground electrode 30, the center electrode 20 and the insulator 10 forms a sufficient gap (i.e., the clearance) therebetween to accommodate the virtual sphere Q having the radius of, at least, 1.2 mm or more.

Thus, if the virtual sphere Q having the radius of, at least, 1.2 mm or more can be accommodated in the clearance, it is unlikely that the cylindrical portion 11 of the front end portion 13 of the insulator 10 or the front end portion 22 of the center electrode 20 comes close to the inner face 33 of the ground electrode 30. Therefore, the distance between the inner face 33 of the ground electrode 30 and the cylindrical portions 11 of the front end portion 13 of the insulator 10, or the distance between the inner face 33 of the ground electrode 30 and the front end portion 22 of the center electrode 20 can be fully secured compared to the size of the spark discharge gap G. As a result, side sparks caused by carbon fouling is prevented.

Further, a projecting amount of the extending portion 36 of the ground electrode 30 from the front end face of the metal shell and that of the cylindrical portion 11 of the front end portion 13 of the insulator 10 from the front end face of the metal shell are specified so that the virtual sphere Q is disposed forward in the axial O direction with respect to the position of, at least, the front end constituent face 57 of the metal shell 50. That is, the spark discharge gap G can be further projected inside of a combustion chamber (not illustrated). Thus, since the spark discharge gap G is disposed further inside of the combustion chamber while maintaining the substantial amount of clearance, a flame kernel generated in the spark discharge gap G is unlikely to be in contact with the ground electrode 30, the metal shell 50 or an inner wall of the combustion chamber (not illustrated) during the growth of the flame kernel. As a result, higher ignitability is achievable.

On the other hand, deterioration in the joint strength between the end face 35 of the ground electrode 30 and the front end constituent face 57 of the metal shell 50 is considered due to chamfering. According to the first embodiment, the end face 35 is formed into a shape corresponding to the front end constituent face 57 as mentioned above so that the entire end face 35 can adjoin the front end constituent face 57. Thus, the contact area therebetween is maintained and the joint strength therebetween improves. More particularly, the spark plug 100 is manufactured as follows.

With reference to FIGS. 4 to 7, a method for manufacturing the spark plug 100 will be described, focusing on a process where the ground electrode 30 is joined to the metal shell 50. In addition, a description of publicly known manufacturing processes shall be simplified or omitted.

Figure 4:
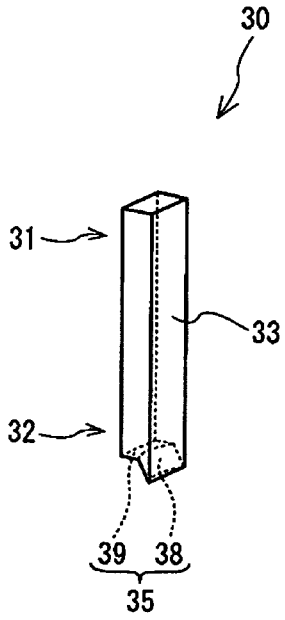
FIG. 4 is a figure showing a joint face formation step that cuts and grinds an end face 35 of a ground electrode 30.

In the manufacturing process of the spark plug 100, a wire rod assuming a rectangular shape in the cross-section and made of nickel alloy that has excellent resistance to corrosion is cut in a predetermined length so as to form the rectangular parallelepiped-shaped ground electrode 30. At this time, as shown in FIG. 4, the end face 35 at the base 32 side of the ground electrode 30 is subjected to a cutting and grinding process. Then, the corresponding flat face 39 corresponding to the shape of the flat face 82 (refer to FIG. 2) of the front end constituent face 57 of the metal shell 50 and the corresponding inclined face 38 inclining with respect to the corresponding flat face 39 and corresponding to the inclined face 81 (refer to FIG. 2) of the front end constituent face 57 are formed (a joint face formation step). The corresponding flat face 39 and the inclining angle of the corresponding inclined face 38 of the ground electrode 30 are positioned so that the ground electrode 30 extends along the axial O direction when the corresponding flat face 39 and the corresponding inclined face 38 are brought into contact with a flat face 182 and an inclined face 181 of a front end constituent face 157 of a metal shell intermediate body 150 (which will be mentioned later), respectively. However, it is not necessary to precisely match together the corresponding flat face 39 and the flat face 182, and the corresponding inclined face 38 and the inclined face 181, and a very small gap therebetween is allowable as long as the sufficient joint strength is maintained after joining. For example, in FIG. 4, in order to correspond to the inclined face 81 which will be formed in a tapered shape, the corresponding inclined face 38 is formed into a rounded shape like an arc with respect to the extending direction of the ground electrode 30. However, the corresponding inclined face 38 does not necessarily assume the rounded shape. It may assume a flat shape. When the corresponding inclined face 38 is formed into a flat shape, some gap is likely to arise between the corresponding inclined face 38 and the inclined face 181 because the inclined face 181 of the metal shell intermediate body 150 assumes a rounded shape. The gap will be filled with a melting portion which will be produced when the ground electrode 30 and the metal shell intermediate body 150 are welded in an electrode joint step (mentioned later) (the melting portion is not shown in the cross-section view in FIG. 2).

Figure 5:
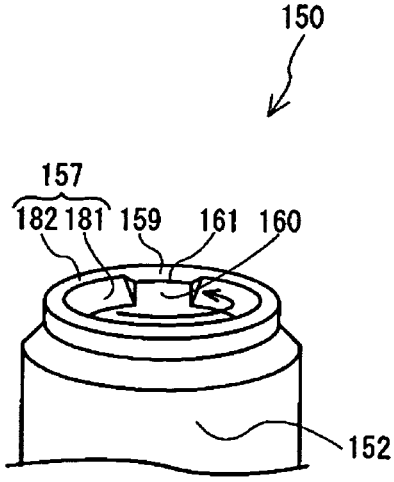
FIG. 5 is a figure showing an inclined face formation process that chamfers an end face 159 of a metal shell intermediate body 150 to thereby form a front end constituent face 157.

On the other hand, a cylindrical body (not illustrated) made of iron system material is subjected to a cutting and grinding process to form the flange 54 or the tool engagement portion 51 or the like. As a result, the metal shell intermediate body 150 used as an original form of the metal shell 50 (refer to FIG. 2) is formed without the thread in the thread portion 152 as shown in FIG. 5. A chamfering process is conducted to the front end side end face 159 of the metal shell intermediate body 150. More particularly, an edge 161 (i.e., an inner edge of the end face 159) formed by the end face 159 and the inner circumferential face 160 of the metal shell intermediate body 150 is chamfered in the circumferential direction as shown with an arrow in FIG. 5 to thereby form the front end constituent face 157 composed of the inclined face 181 and the flat face (i.e., a portion of the end face 159 where no chamfering is conducted) (an inclined face formation step). In addition, FIG. 5 shows an in-process state of the metal shell intermediate body 150 in which the front end constituent face 157 composed of the inclined face 181 and the flat face 182 is formed by chamfering the end face 159.

Figure 6:
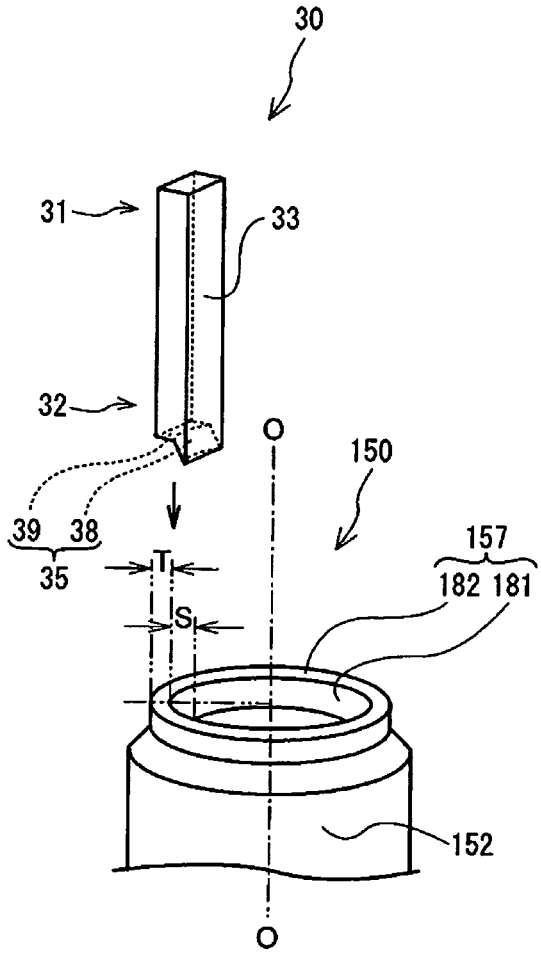
FIG. 6 is a figure showing an electrode joint step that joins the ground electrode 30 to the metal shell intermediate body 150.

Next, as shown in FIG. 6, the end face 35 of the ground electrode 30 is joined to the front end constituent face 157 of the metal shell intermediate body 150. At this time, the corresponding inclined face 38 and the corresponding flat face 39 of the end face 35 are brought into contact with the inclined face 181 and the flat face 182 of the front end constituent face 157, respectively, whereby the entire end face 35 of the ground electrode 30 adjoins the front end constituent face 157 of the metal shell intermediate body 150. Then, the ground electrode 30 is held so as to extend from the base 32 toward the front end portion 31 in the axial O direction. In this state, the end face 35 and the front end constituent face 157 are welded (e.g., resistance welding) to thereby join the ground electrode 30 to the metal shell intermediate body 150 (an electrode joint step).

Figure 7:
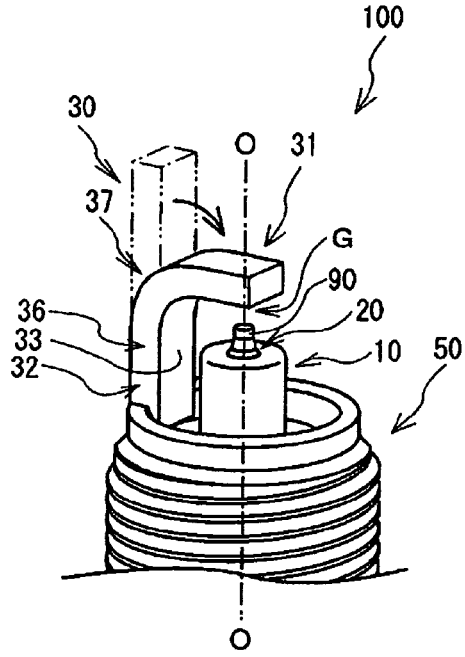
FIG. 7 is a figure showing a gap formation step that forms a spark discharge gap G by bending the ground electrode 30.

The metal shell intermediate body 150 to which the ground electrode 30 is joined is formed into the metal shell 50 shown in FIG. 1 after rolling the thread in the thread portion 152. The insulator 10 where the center electrode 20 and the terminal fitting 40 are assembled in a separate process is accommodated in a cylindrical hole of the metal shell 50 and held by caulking. Thereafter, as shown in FIG. 7, the front end portion 31 of the ground electrode 30 is bent toward the axis O so that the inner face 33 thereof faces the noble metal tip 90 joined at the front end of the center electrode 20, whereby the spark discharge gap G is formed therebetween. As a result, the spark plug 100 is completed (a gap formation step).

In the gap formation step, the bending portion 37 is formed (bent) so that the virtual sphere Q having the radius of 1.2 mm (refer to FIGS. 2 and 3) and being in contact with the inner face 33 of the bending portion 37 is not brought into contact with the cylindrical portion 11 of the front end portion 13 of the insulator 10 and the front end portion 22 of the center electrode 20 (including the noble metal tip 90 joined to the front end portion 22). At this time, the bending portion 37 is not formed right next to the base 32. The extending portion 36 extending in the axial O direction is formed between the base 32 and the bending portion 37. That is, the ground electrode 30 is not immediately bent at the joint portion of the metal shell 50 and the ground electrode 30, but beginning to bend at some point from the base 32 (by the equivalent distance of the extending portion 36). By forming the extending portion 36, the inner face 33 of the ground electrode 30 is unlikely to come close to the cylindrical portion 11 of the front end portion 13 of the insulator 10 at the base 32 side with respect to the bending portion 37.

Example 1

The spark plug 100 manufactured in this way can maintain sufficient clearance with specifying a dimension of the virtual sphere Q that is in contact with the inner face 33 of the bending portion 37 of the ground electrode 30 and is neither in contact with the center electrode 20 (including the noble metal tip 90) nor the insulator 10. An evaluation was conducted to confirm the effect of the invention. In this evaluation, several samples of the spark plug were produced in which the magnitude of bending of the ground electrode 30 was differentiated in the gap formation step of the spark plug 100. While maintaining the spark discharge gap G of 0.9 mm, the radius of the virtual sphere Q of each sample was changed by 0.1 mm within the range from 0.7 mm to 1.5 mm. In addition, the bending conditions were changed by shifting a border between the extending portion 36 and the bending portion 37 (a position where the ground electrode 30 starts to bend at the base 32 side), or changing a degree of bending (a bending radius) in the bending portion 37.

In order to simulate the carbon fouling, carbon was provided to the front end portion of the insulator of each sample. Further, each sample was mounted on a pressure chamber, and spark discharge was conducted 100 times under the barometric pressure of 0.6 Mpa. The number of side spark incidence (side spark produced between the front end portion of the insulator and the inner face of the bending portion or the extending portion of the ground electrode) is counted to thereby calculate a side spark incidence rate. The result of the evaluation is shown in a graph in FIG. 8.

Figure 8:
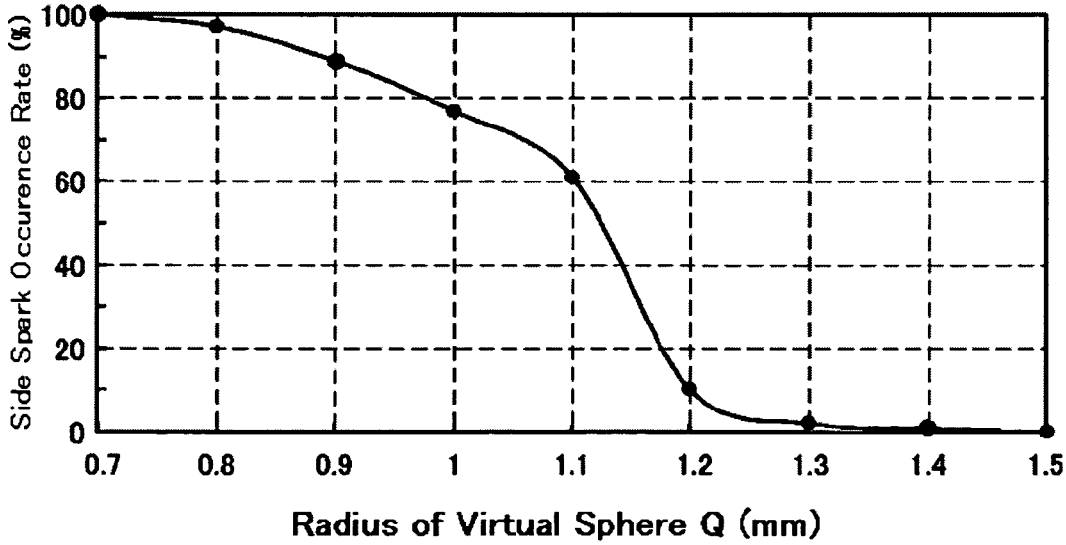
FIG. 8 is a graph showing a relationship between a radius of a virtual sphere Q (size of a clearance) and a side spark occurrence rate.

As shown in FIG. 8, the side spark incidence rate was 100% when the radius of virtual sphere Q was 0.7 mm. The side spark incidence rate fell gradually as the radius of virtual sphere Q became large. When the radius of virtual sphere Q was 1.1 mm, the side spark incidence rate was about 60%. However, when the radius of virtual sphere Q was 1.2 mm, the side spark incidence rate sharply dropped to about 10%. Further, as the radius of virtual sphere Q became large, the side spark incidence rate is decreased. When the radius was 1.5 mm, the side spark was not generated. According to the result of the evaluation, it is found that the side sparks can be fully prevented if the spark plug secures sufficient clearance to accommodate the virtual sphere Q of, at least, 1.2 mm or more in radius by bending the ground electrode.

Example 2

Next, an evaluation for testing the joint strength when a mechanical load is applied to the joint portion of the ground electrode 30 and the metal shell 50 is described. In this evaluation, several metal shell intermediate bodies having the front end constituent face 157 each of which is chamfered with a different magnitude were prepared in the inclined face formation step of manufacturing the spark plug 100. As shown in FIG. 2 or 6, five types of metal shell intermediate bodies were prepared. In these metal shell intermediate bodies, a proportion of a length S of the chamfered inclined face in the radial direction of the metal shell intermediate body (FIG. 2 shows a finished metal shell) to a length S+T ("T" is a length of the flat face after chamfering in the radial direction) of the front end constituent face before chamfering was set to be 0, 7, 10, 14 and 17(%), respectively. Then, five ground electrodes were produced in which the end face thereof was sectioned perpendicular to the extending direction of the ground electrode so as to assume a flat shape. Thus-formed ground electrodes were welded to each metal shell intermediate body and they were served as a sample group 1. That is, the sample group 1 is equivalent to the conventional art in which the end face of the ground electrode is in contact with the flat face of the front end constituent face of the metal shell, while the ground electrode and the metal shell were joined to each other, leaving a large gap with the inclined face.

Similar to the above, another five types of metal shell intermediate bodies were prepared in which a proportion of the length of the chamfered inclined face in the radial direction of the metal shell intermediate body to the length of the front end constituent face before chamfering was set to be 7, 10, 14, 17 and 100(%). Then, similar to the first embodiment, a plurality of ground electrodes were produced in which the end face thereof was sectioned so as to correspond to the shape of the front end constituent face of the metal shell intermediate body. The thus-formed ground electrodes were welded to the metal shell intermediate bodies, respectively, and serves as a sample group 2. The sample group 2 is an equivalent of the first embodiment, in which the ground electrode and the metal shell were joined together while the entire end face of the ground electrode is brought into contact with the front end constituent face (the flat face and the inclined face) of the metal shell intermediate body.

In these samples, the front end portion of each ground electrode was pressed radially inward of the metal shell intermediate body so as to be bent 90 degrees or more with respect to the axis O. Next, the front end portion was pressed radially outward of the metal shell intermediate body so as to be bent 90 degrees or more with respect to the axis O. Then, each joint portion of the ground electrode and the metal shell was visually observed as to whether or not there was any peeling in the joint portion. The result of the evaluation is shown in Table 1.

TABLE 1

| | Proportion of the length of the inclined portion in the radial direction in the front end face of the metal shell (metal shell intermediate body) (%) | | | | | |
|---|---|---|---|---|---|---|
| Sample Group | 0 | 7 | 10 | 14 | 17 | 100 |
| 1. Related Art | ○ | ○ | ○ | x | x | — |
| 2. Embodiment | — | ○ | ○ | ○ | ○ | ○ |

As shown in Table 1, in the front end constituent face of the metal shell intermediate body in the sample group 1, no peeling was observed in the samples having the small size of the inclined face in the radial direction and the proportion of 0, 7 and 10(%). However, peeling was observed in the sample having the proportion of 14 and 17(%). On the other hand, in the sample group 2, peeling was not observed in any sample. That is, when the proportion of the inclined face in the front end constituent face increases in the radial direction and the proportion of the flat face decreases, a portion of the end face of the ground electrode which can be in contact with the front end constituent face of the metal shell decreases. As a result, the joint strength deteriorates after welding. However, when the end face of the ground electrode and the front end constituent face are joined while the entire end face is brought into contact with the front end constituent face according to the first embodiment, a sufficient joint strength can be obtained regardless of the chamfering size even though bending load is applied to the joint portion.

Example 3

Further, another evaluation was conducted in order to observe the joint strength when heating and cooling load are applied to the joint portion of the ground electrode 30 and the metal shell 50. In this evaluation, the same sample groups 1 and 2 as in the example 2 were prepared, and the heating and cooling load were applied to each sample. More particularly, the joint portion of the ground electrode 30 and the metal shell 50 was heated at 500 degrees C. by a burner for 2 minutes and left to stand at a room temperature for 1 minute. This cycle was repeated 1000 times. After the 1000 cycles, the same bending load as in the example 2 was applied to the joint portion of the ground electrode and the metal shell and visually checked as to whether or not any peeling occurred. The result of this evaluation is shown in Table 2.

TABLE 2

| | Proportion of the length of the inclined portion in the radial direction to the front end face of the metal shell (metal shell intermediate body)(%) | | | | | |
|---|---|---|---|---|---|---|
| Sample Group | 0 | 7 | 10 | 14 | 17 | 100 |
| 1. Related Art | ○ | ○ | x | x | x | — |
| 2. Embodiment | — | ○ | ○ | ○ | ○ | ○ |

As shown in Table 2, in the sample group 1, the samples having the proportion of 0 and 7(%) and having the small size of inclined face in the radial direction to the front end constituent face of the metal shell intermediate body did not show any peeling. However, the samples having the proportion of 10, 14 and 17(%) exhibited some peeling. On the other hand, no peeling was observed in any of the samples of sample group 2. According to the result of this evaluation, when the end face of the ground electrode and the front end constituent face are joined while the entire end face is brought into contact with the front end constituent face according to the first embodiment, sufficient joint strength can be obtained regardless of the severer heating and cooling load application than in the case of the example 2.

Example 4

Next, an evaluation was conducted in order to check the effect of defining the angle formed by the inner circumferential face 58 and the inclined face 81 of the metal shell 50. In this evaluation, eight types of spark plug were produced. The angle formed by the inner circumferential face 158 and the inclined face 181 of each sample was differentiated by 10 degrees within the range from 100 to 170 degrees, when chamfering the inner circumference side of the end face 159 of the metal shell intermediate body 150 in the inclined face formation step of manufacturing the spark plug 100. At this time, the size of the inclined face 181 formed by chamfering the edge was adjusted so that the length of the inclined face 181 of each sample was the same length (1.13 mm) on a cross-sectional outline of the chamfered metal shell intermediate body 150 including an axis O thereof. Further, a sample 1 (equivalent to the conventional art) where the end face 159 of the metal shell intermediate body 150 was not chamfered was prepared. In addition, when producing these samples, the thread of the metal shell had a nominal diameter of M12, and the insulator was assembled in the metal shell so that a 1.5 mm clearance is secured between the outer circumferential face of the front end portion of the cylindrical portion and the inner circumferential face of the metal shell. Further, the ground electrode had the size of 1.3 mm×2.7 mm in the cross-section and welded by resistance welding. Here, the conditions of resistance welding were the same as that of the sample 1 (equivalent to the conventional art) where any welding droop does not occur when conducting the resistance welding.

First, the joint portion of the ground electrode and the metal shell of each sample was observed. Any sample without welding droop in the joint portion was indicated as "○", representing an excellent weldability. Any sample with welding droop in the joint portion was also indicated as "○" as long as the welding droop had a radial projecting length (rising) of 0.2 mm or less and an axial length (spread) of 1 mm or less, because the welding droop with such a size is unlikely to cause side sparks. On the other hand, when the welding droop in the joint portion had the radial projecting length (rising) of larger than 0.2 mm or the axial length (spread) of larger than 1 mm, the sample having such a welding droop was indicated as "Δ", because it is likely to cause side sparks.

Next, after removing the welding droop of each sample, the samples were mounted on a pressure chamber. The chamber was filled by air (atmosphere) so as to adjust an inner pressure thereof was to be 0.4 MPa. Then, spark discharge was conducted 100 times under the conditions that the air flew at 5.0 m/sec from a side of the ground electrode toward the spark discharge gap G. Spark discharge was conducted for 100 times and they were taken by photos. The number of spark discharges (i.e., side sparks) not generated in the normal spark discharge gap G, but generated between the edge, which is formed by the inner circumferential face and the inclined face of the metal shell, and the outer surface of the insulator were counted. Further, a side spark reduction rate of sample 1 (equivalent to the conventional art) was calculated where the number of side spark incidence in each sample is a numerator and the number of side spark incidence in the sample 1 is a denominator. In addition, the reduction rate of the sample where no side spark occurred out of 100 spark discharges was indicated as 100%. The result of the test is shown in Table 3.

TABLE 3

| Sample | Degree α[°] | Weldability | Side spark reduction rate [%] |
|---|---|---|---|
| 1 [Related Art] | 90 | ○ | — |
| 2 | 100 | ○ | 48.1 |
| 3 | 110 | ○ | 59.3 |
| 4 | 120 | ○ | 81.2 |
| 5 | 130 | ○ | 85.2 |
| 6 | 140 | ○ | 96.3 |
| 7 | 150 | ○ | 100 |
| 8 | 160 | Δ | 100 |
| 9 | 170 | Δ | 100 |

As shown in Table 3, regarding the weldability, the samples 2-7 where the angle α formed by the inner circumferential face and the inclined face of the metal shell is 150 degrees or less showed no welding droop or a relatively small welding droop that was unlikely to be an origin of side sparks. However, in the samples 8 and 9 having the angle α of larger than 150 degrees, a large size of welding droop, which was likely to be the origin of side sparks, was found. Thus, as the angle α becomes large, the welding droop is more likely to occur because calorific capacity becomes small due to decrease in volume of a portion where the corresponding inclined face of the ground electrode is formed. Thereby, the portion is easily melted at the time of the resistance welding, and the welding droop is likely to be produced.

Regarding the side spark reduction rate, the samples 7-9 having the angle α of 150 degrees or more, which is formed by the inner circumferential face and the inclined face of the metal shell, exhibited no side spark and the reduction rate of 100%. Further, the samples 4-6 having the angle α of 120 degrees or more to less than 150 degrees exhibited the side spark reduction rate of over 80% to the sample 1 (equivalent to the conventional art), which is deemed to have sufficient effect. However, the samples 2 and 3 having the angle α of below 120 degrees exhibited the side spark reduction rate of less than 60% to the sample 1 (equivalent to the conventional art) and did not show any great effect although the side spark incidence rate decreased. According to the results of the evaluation, when the angle α formed by the inner circumferential face and the inclined face of the metal shell was within the range from 120 degrees or more to 150 degrees or less, the side sparks are effectively prevented.

Although the metal shell having a nominal diameter of a thread ridge of M12 was used in the example 4 for the evaluation, all the samples exhibited a reduction in the side spark incidence rate compared to the sample 1 (equivalent to the conventional art). In this point, in the spark plug having the nominal diameter of M12 or less, more particularly, having a clearance of 1.5 mm or less between the outer circumferential face of the insulator and the inner circumferential face of the metal shell, the side sparks are very likely to occur when the conventional spark plug having no inclined face serving as the front end constituent face of the metal shell is employed. As in the spark plug 100 according to the first embodiment, it is effective for the spark plug having a small diameter to have the inclined face 81 in the front end constituent face 57 of the metal shell 50 and the angle α within the range from 120 degrees or more to 150 degrees or less. Furthermore, although the ground electrode having the size of 1.3 mm×2.7 mm in the cross-section was used in the example 4, this does not limit the cross-section area of the ground electrode, and the suitable cross-section area thereof is 1.3 to 4 $mm^2$.

Example 5

Next, an evaluation was conducted in order to observe the effect of preventing the side sparks. In the evaluation, the positional relationship between the border A and the border B was specified, where the border A is between the cylindrical portion 11 and the outer diameter transition part 14 of the insulator 10 in the axial O direction, and where the border B is between the inclined face 81 and the inner circumferential face of the metal shell 50 in the axial O direction. Seven types of the insulator each having the same length of the front end portion were produced and assembled with the separately-formed metal shell, respectively. The position of the border A between the cylindrical portion and the outer diameter transition part of each insulator was varied by 0.5 mm in the axial O direction. As a result, seven types of spark plug were produced. The border A of a sample 11 was positioned at 1 mm away from the border B toward the front end side in the axial O direction, and that of a sample 17 was positioned at 2 mm away from the border B toward the rear end side. The positions of the border A with respect to the border B of the remaining samples varied by 0.5 mm within the above range (from 1 mm toward the front end side to 2 mm toward the rear end side). When these samples were produced, the metal shell provided with the thread ridge having a nominal diameter of M10 was used. Also, the front end constituent face was chamfered so that the angle α formed by the inner circumferential face and the inclined face was to be 120 degrees. Although the insulator had a suitable size to be assembled with this metal shell, the front end portion of the cylindrical portion was formed so that the clearance between the outer circumferential face of the cylindrical portion and the inner circumferential face of the metal shell was to be 1.3 mm after the assembly. Further, the ground electrode had a size of 1.1 mm×2.2 mm in the cross-section and was welded by resistance welding. In addition, the resistance welding was conducted under the conditions that a welding droop was not generated.

Next, in order to simulate the carbon fouling, carbon was provided to the front end portion (more particularly, the front end side with respect to the position B in the cylindrical portion) of the insulator of each sample. Further, each sample was mounted on a pressure chamber, and the chamber was filled by air (atmosphere) so as to adjust an inner pressure thereof was to be 0.4 MPa. Further, similar to the example 4, spark discharge was conducted 100 times under the conditions that fuel was supplied (sprayed) with a flow velocity of the 5.0 m/sec from the side of the ground electrode towards the spark discharge gap G of each sample. These 100 spark discharges were taken by photos. The number of spark discharges (i.e., side sparks) not generated in the normal spark discharge gap G, but generated between the edge, which was formed by the inner circumferential face and the inclined face of the metal shell, and the outer surface of the insulator, was counted. The result of the evaluation is shown in Table 4.

TABLE 4

| Sample | Position of border A with respect to border B in axial direction | Distance between border A and border B in axial direction [mm] | Side spark incidence rate [%] |
|---|---|---|---|
| 11 | Front end side | 1 | 22 |
| 12 | | 0.5 | 19 |
| 13 | Same | 0 | 16 |
| 14 | Rear end side | 0.5 | 5 |
| 15 | | 1 | 3 |
| 16 | | 1.5 | 2 |
| 17 | | 2 | 2 |

As shown in Table 4, the samples 11, 12 in which the border A is positioned at the front end side with respect to the border B in the axial O direction exhibited the side spark incidence rate of 22% and 19%, respectively, and the side spark occurred once in about 5 times at the time of carbon fouling. As for the samples 11, 12, in the axial O direction, the outer diameter transition part of the insulator is positioned at the border A, and the gap (distance) between the border A and border B became small. The side spark incidence rate was 16% in the sample 13 where the position of the border A was the same as that of the border B in the axial O direction. However, in the samples 14 to 17 where the border A was positioned at the rear end side with respect to the border B in the axial O direction, the side spark incidence rate decreased to 5% or less. In the samples 14 to 17, since the cylindrical portion of the insulator was positioned at the border B in the axial O direction, the gap (distance) therebetween was kept uniform regardless of the position of the border B. Thus, the border A is preferably positioned at the rear end side with respect to the border B in the axial O direction.

Second Embodiment

Next, a spark plug 200 according to a second embodiment will be described with reference to FIG. 9 and FIG. 10. The spark plug 200 according the second embodiment shown in FIG. 9 and FIG. 10 has the similar composition as that of the spark plug 100 according to the first embodiment, except for the joint portion of a ground electrode 230 and a metal shell 250. Here, new reference numerals are provided to the different parts and portions in the following mode, and repeated descriptions of the similar parts and portions are omitted.

Figure 9:
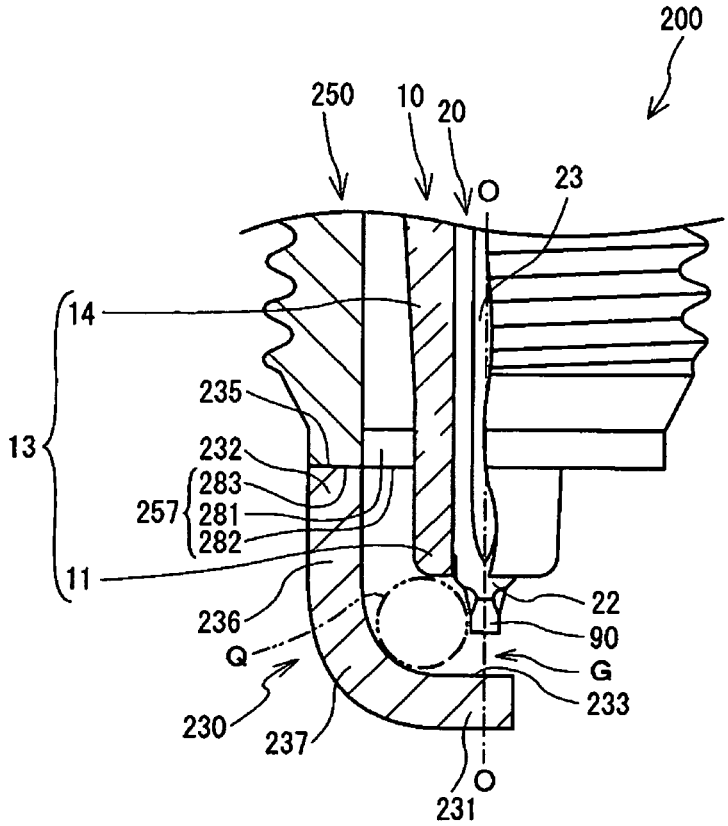
FIG. 9 is an enlarged relevant sectional view showing a front end side of a spark plug 200 according to a second embodiment.
Figure 10:
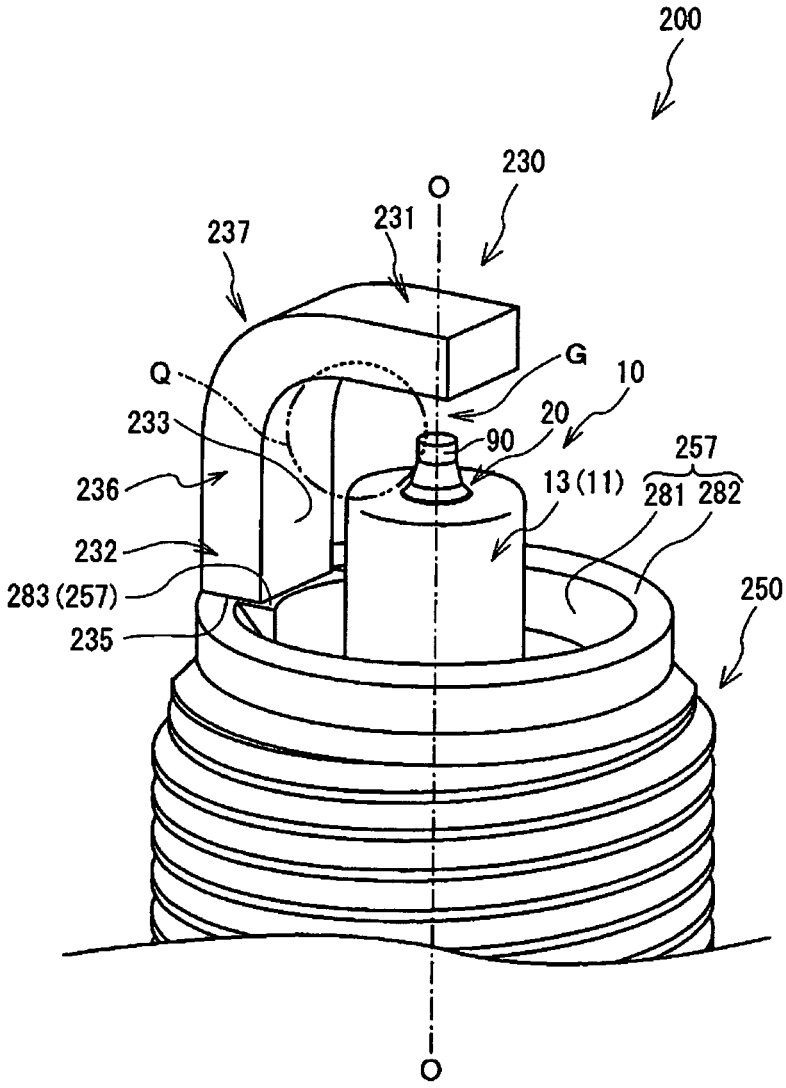
FIG. 10 is a perspective view showing a composition of the front end side of the spark plug 200.

As shown in FIG. 9 and FIG. 10, in a front end constituent face 257 of the metal shell 250 of the spark plug 200 according to the second embodiment, a portion to which an end face 235 of the ground electrode 230 is joined is provided without chamfering. That is, the front end constituent face 257 of the metal shell 250 includes a non-chamfered flat face 283 perpendicular to the axis O and located at the portion to which the ground electrode 230 is joined. Further, in a portion to which the ground electrode 230 is not joined, a chamfered inclined face 281 assuming an inclined shape and a non-chamfered flat face 282 are provided as similar to the first embodiment. On the other hand, the end face 235 of the ground electrode 230 is formed as a flat face perpendicular to the extending direction of the ground electrode 230. Therefore, before welding the ground electrode 230 to the metal shell 250, the almost whole end face 235 of the ground electrode 230 is brought into contact with the flat face 283 of the front end constituent face 257 of the metal shell 250.

An extending portion 236 extends toward the front end side from a base 232 of the ground electrode 230 in the axial O direction and keeps a predetermined distance to the outer circumferential face of the cylindrical portion 11 of the front end portion 13 of the insulator 10 in the radial direction, as similar to the first embodiment. Similarly, in a bending portion 237 bent toward the front end portion 231 from the extending portion 236, the inner face 233 of the ground electrode 230, the cylindrical portion 11 of front end portion 13 of the insulator 10 and the front end portion 22 of the center electrode 20 does not come close to each other so as to form a sufficient clearance therebetween. More particularly, as shown in FIG. 9, a virtual sphere Q having the radius of 1.2 mm and being in contact with the inner face 233 of the bending portion 237 of the ground electrode 230 is neither in contact with the center electrode 20 (including the noble metal tip 90) nor the insulator 10, to thereby maintain the sufficient clearance.

The flat face 283 of the front end constituent face 257 is formed so that the entire end face 235 of the ground electrode 230 is in contact with and welded to the front end constituent face 257 of the metal shell 250. As a result, at least the same area as that of the end face 235 is provided, whereby sufficient joint strength can be obtained after welding. Further, when the inclined face 281 and the flat face 282 are formed by chamfering a portion excluding the flat face 283 of the front end constituent faces 257, side sparks caused by the concentration of electric field on the edge where no chamfering is provided are prevented, as similar to the first embodiment. Thus, when the size of the virtual sphere Q is specified so as to maintain the sufficient clearance, it is possible to prevent the cylindrical portion 11 of the front end portion 13 of the insulator 10 or the front end portion 22 of the center electrode 20 from coming close to the inner face 33 of the ground electrode 30. Therefore, a distance (clearance) between the inner face 233 of the ground electrode 230 and the cylindrical portions 11 of the front end portion 13 of the insulator 10, or a distance (clearance) between the inner face 233 of the ground electrode 230 and the front end portion 22 of the center electrode 20 can be sufficiently secured compared to the spark discharge gap G. As a result, side spark caused by carbon fouling can be prevented.

The process of manufacturing the spark plug 200 having such configuration according to the second embodiment is different from that of the spark plug 100 according to the first embodiment, the front end constituent face 257 is chamfered after joining the ground electrode 230 to the front end constituent face 257 of the metal shell 250. Hereafter, with reference to FIGS. 11-13, the manufacturing process of the spark plug 200 will be described focusing on a process in which the ground electrode 230 is joined to the metal shell 250. Description of any publicly known portion in the manufacture process shall be simplified or omitted.

Figure 11:
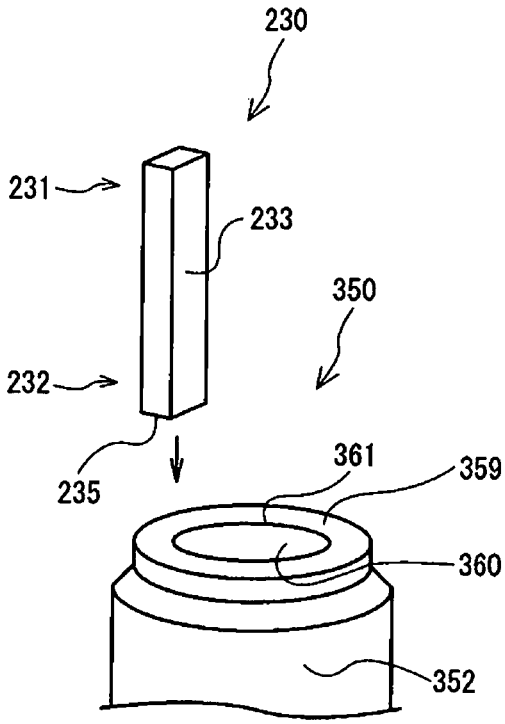
FIG. 11 is a figure showing an electrode joint step that joins a ground electrode 230 to a metal shell intermediate body 350.

As shown in FIG. 11, in the manufacturing process of the spark plug 200, a wire rod assuming a rectangular shape in the cross-section and made of nickel alloy that has excellent resistance to corrosion is cut into a predetermined length so as to form the rectangular parallelepiped ground electrode 230. The end face 235 at the base 232 side is formed into a flat face perpendicular to the extending direction of the ground electrode 30.

In a manner similar to the first embodiment, a metal shell intermediate body 350 serving as an original form of the metal shell 250 (refer to FIG. 9) is formed. Then, the end face 235 of the ground electrode 230 is joined to a front end constituent face 357 of the metal shell intermediate body 350. The metal shell intermediate body 350 has the front end constituent face 357 before chamfering, and the entire end face 235 of the ground electrode 230 is in contact with the front end constituent face 357. The ground electrode 230 is held so as to extend toward the front end portion 231 from the base 232 in the axial O direction. In this state, the end face 235 and the front end constituent face 357 are welded each other. As a result, the ground electrode 230 is joined to the metal shell intermediate body 350 (electrode joint step).

Figure 12:
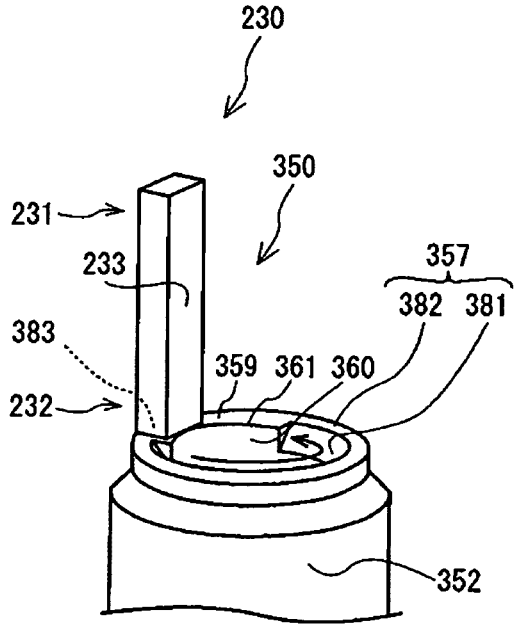
FIG. 12 is a figure showing an inclined face formation step that chamfers an end face 359 of the metal shell intermediate body 350 to thereby form a front end constituent face 357.

Next, as shown in FIG. 12, the front end constituent face 357 of the metal shell intermediate body 350 is subjected to a chamfering. More particularly, an edge 361 formed by the front end constituent face 357 and the inner circumferential face 360 of the metal shell intermediate body 350 is chamfered, except for a portion to which the ground electrode 230 is joined, as shown with an arrow in FIG. 12 to thereby form an inclined face 381 and a flat face 382. Further, the portion to which the ground electrode 230 is joined serves as a flat face 383 (inclined face formation step). In addition, FIG. 12 shows the metal shell intermediate body 350 in process where the inclined face 381 and the flat face 382 are formed in the front end constituent face 357.

Figure 13:
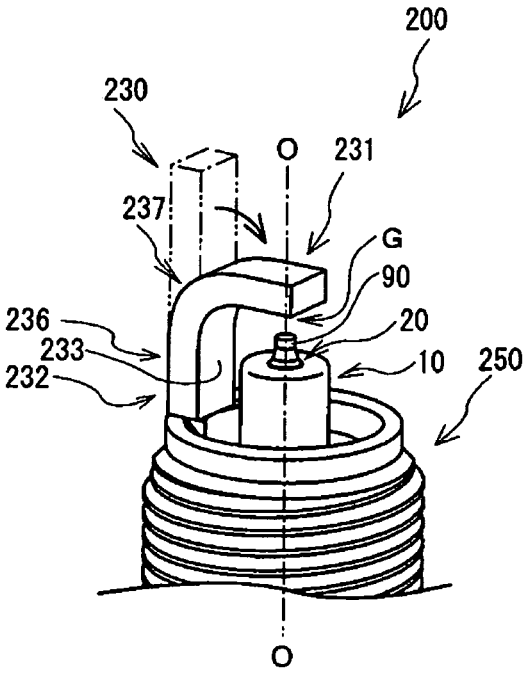
FIG. 13 is a figure showing a gap formation step that forms a spark discharge gap G by bending the ground electrode 230.

The metal shell intermediate body 350 to which the ground electrode 230 is joined is formed into the metal shell 250 shown in FIG. 9 after rolling the thread on the threaded portion 352. Similar to the first embodiment, the insulator 10 where the center electrode 20 and the terminal fitting 40 are assembled is accommodated and caulked in the cylindrical hole of the metal shell 250. Thereafter, as shown in FIG. 13, the front end portion 231 of the ground electrode 230 is bent towards the axis O so that an inner face 233 of the ground electrode 230 faces the noble metal tip 90 joined to the front end portion 22 of the center electrode 20, thereby forming the spark discharge gap G therebetween (a gap formation step). As a result, the spark plug 200 is completed. In the gap formation step, the extending portion 236 and the bending portion 237 of the ground electrode 230 are provided so that the virtual sphere Q (refer to FIGS. 9, 10) having the radius of 1.2 mm and being in contact with the inner face 233 of a bending portion 237 is neither in contact with the cylindrical portion 11 of the front end portion 13 of the insulator 10 nor the front end portion 22 (including the noble metal tip 90) of the center electrode 20. This is similar to the first embodiment.

Figure 15:
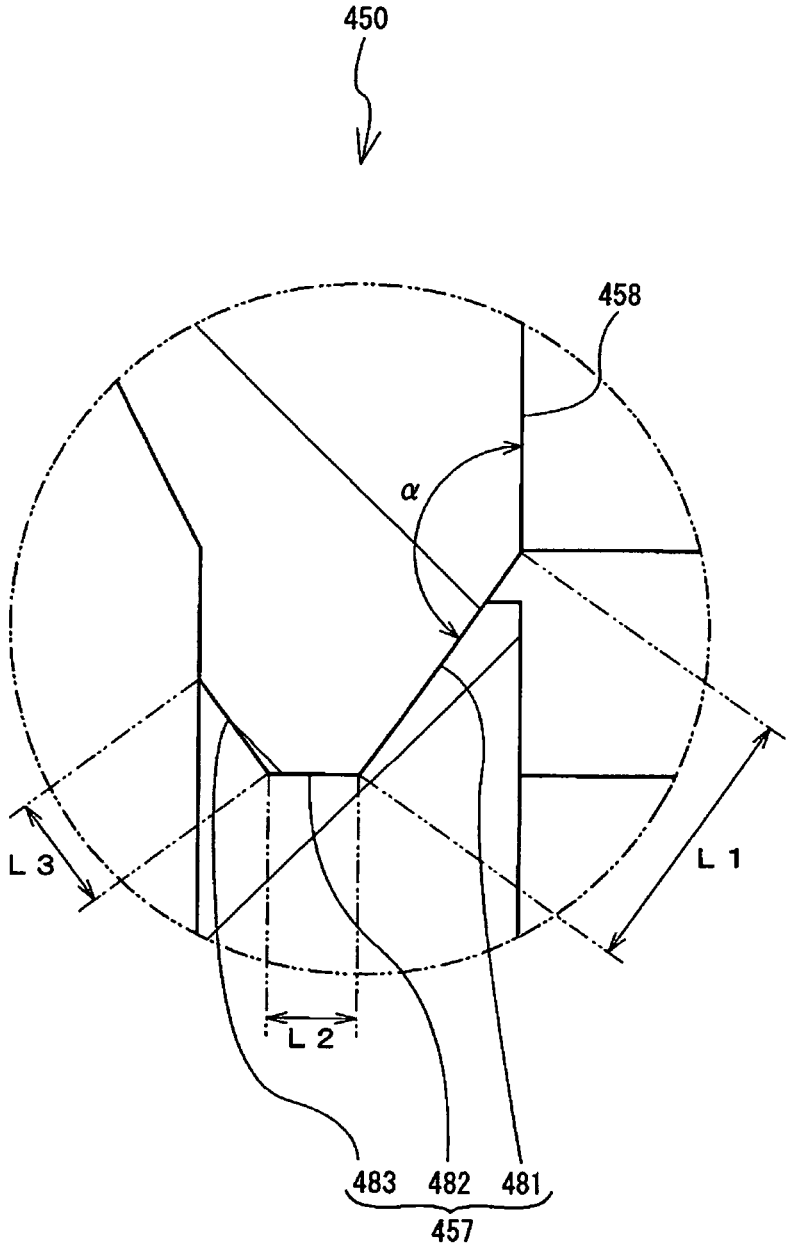
FIG. 15 shows a front end constituent face 457 of a metal shell 450 as a modification, and is an enlarged view of the portion circled with a two-dot chain C in FIG. 2.
Figure 16:
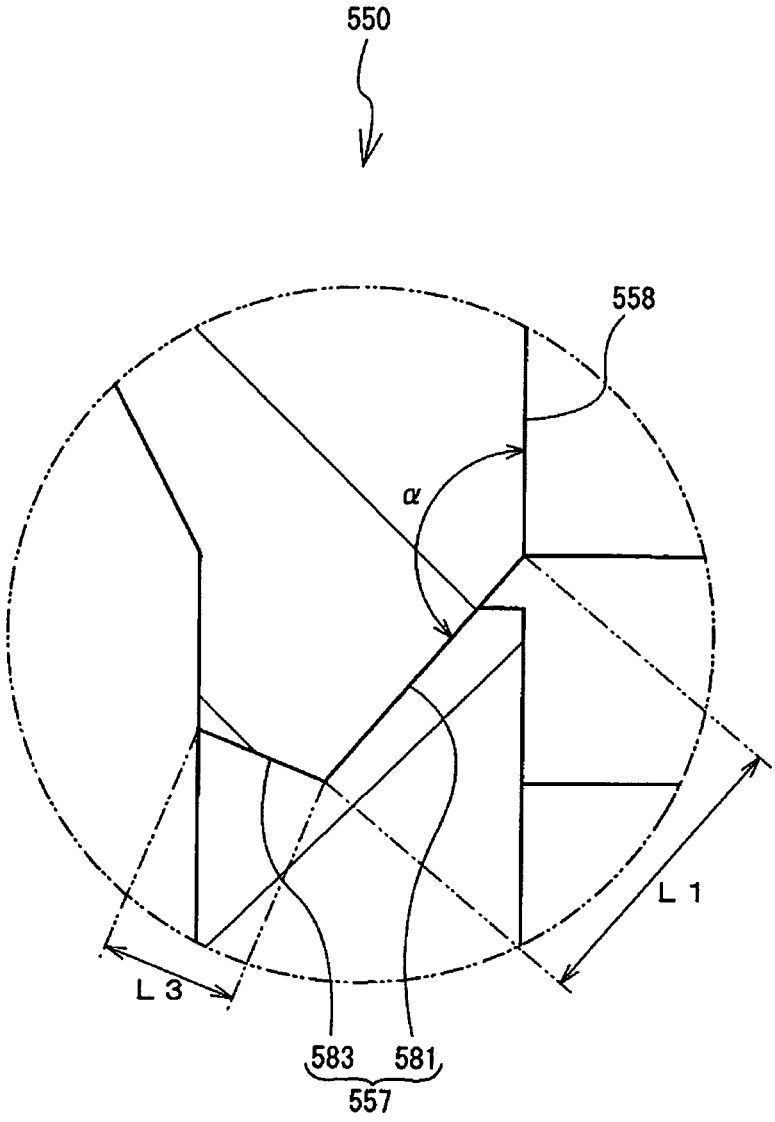
FIG. 16 shows a front end constituent face 557 of a metal shell 550 as a modification, and is an enlarged view of the portion circled with a two-dot chain C in FIG. 2.

In addition, various modification of the embodiments described above will occur. For example, although the front end constituent face 57 of the metal shell 50 is composed of the inclined face 81 and the flat face 82 by chamfering the inner circumference edge of the end face 159 of the metal shell intermediate body 150 in the first embodiment, the shape and size of the chamfering may be selective as long as the above-mentioned conditions are fulfilled. More particularly, as shown in FIG. 15, a front end constituent face 457 of a metal shell 450 may be composed of a flat face 482 facing forward (front end side) in the axial O, an inclined face 481 formed by chamfering a radially inward edge thereof and an inclined face 483 formed by chamfering a radially outward edge thereof. In this case, on the outline of the metal shell 450, a length L1 of the inclined face 481 which is connected to the inner circumferential face 458 of the metal shell 450 may be longer than a length L2 of the flat face 482 on the outline or a length L3 of the inclined face 483 on the outline. Further, as shown in FIG. 16, a front end constituent face 557 of a metal shell 550 is composed of an inclined face 581 facing radially inward (i.e., the diameter thereof increases toward the front end side from the rear end side in the axial O direction) and an inclined face 583 facing radially outward (i.e., the diameter decreases toward the front end side from the rear end side in the axial O direction). In this case, on the outline of the metal shell 550, a length L1 of the inclined face 581 which is connected to an inner circumferential face 558 of the metal shell 550 may be longer than a length L3 of the inclined face 583 on the outline. Furthermore, the angle $\alpha$ formed by the inclined face 481, 581 and the inner circumferential face 458, 558, respectively, may satisfy the relationship: 120 degrees<=$\alpha$<=150 degrees. In this case, the end face of the ground electrode may also be formed according to the size or the shape of the inclined faces and the flat face.

Although the ground electrode 30 is formed by cutting the rectangular wire rod in the cross-section, the corresponding inclined face 38 and the corresponding flat face 39 may be formed in the portion serving as the end face 35. Further, in the second embodiment, when the joint portion to the ground electrode 230 is left when chamfering the front end constituent face 357 of the metal shell intermediate body 350 in the inclined face formation step (refer to FIG. 12), the edge 361 is left in the flat face 383. However, the edge 361 in the flat face 383 may also be chamfered.

In the second embodiment, after joining the end face 235 of the ground electrode 230 to the front end constituent face 357 of the metal shell intermediate body 350, the front end constituent face 357 was chamfered, leaving the joint portion therebetween so as to form the inclined face 381. However, this chamfering process may be conducted before joining the ground electrode 230. In this case, the joint portion where the ground electrode 230 is joined to the front end constituent face 357 is defined in advance, and the front end constituent face 357 is chamfered, leaving the joint portion to thereby form the inclined face 381. Thereafter, the end face 235 of the ground electrode 230 is joined to the joint portion.

Although the front end constituent face 57, 257 of the metal shell 50, 250 is chamfered in the first and second embodiments, it may be rounded. In this case, in the method for manufacturing the spark plug 100 according to the first embodiment, the shape of the corresponding inclined face 38 of the end face 35 of the ground electrode 30 may be formed into a curved face so as to be securely in contact with the rounded inclined face 181 of the metal shell intermediate body 150.

The ground electrode 30, 230 may include a core material with high thermal conductivity, such as Cu. In this case, the core material is exposed at the end face 35,235 so as to be in contact with the front end constituent face 57,257 of the metal shell 50,250. Then, the ground electrode 30,230 may be joined to the metal shells 50, 250, resulting in an improvement in heat conductivity. Further, in light of maintaining the joint strength between the ground electrode 30,230 and the metal shell 50,250, a volume where the core material is exposed in the end face 35,235 of the ground electrode 30,230 is preferably controlled. In this case, when the ground electrode 30 has the corresponding inclined face 38 as in the first embodiment, the core material is preferably exposed at the corresponding inclined face 38. As a result, the contact area between a portion where the core material is not exposed (i.e., a circumferential material of the ground electrode) and the front end constituent face 57 can be fully secured while a greater contact area between the core material and the front end constituent face 57 can be secured compared to the case where the core material is exposed at the corresponding flat face 39. As a result, both maintenance of the joint strength and improvement in heat conduction are achievable.

Having described the invention, the following is claimed:

1. A spark plug, comprising:

a center electrode extending in an axial direction;

an insulator having an axial bore extending in the axial direction and holding the center electrode in the axial bore at a front end side;

a cylindrical metal shell radially surrounding the insulator so as to hold the insulator and having a front end constituent face at a front end side opening thereof, wherein the front end constituent face is comprised of a visible external surface as viewed from a front end side in the axial direction of the spark plug, and has a plurality of faces; and a ground electrode having (a) one end joined to at least one of the plurality of faces constituting the front end constituent face and (b) an other end bent toward an inner circumferential of the metal shell so as to form a spark discharge gap with a front end portion of the center electrode, the ground electrode further comprising (i) an extending portion extending in the axial direction from the one end to the other end and (ii) a bending portion between the extending portion and the other end, wherein a virtual sphere having a radius of 1.2 mm is neither in contact with the center electrode nor the insulator, and is assumed to be in contact with an inner face of the bending portion of the ground electrode that faces toward the center electrode, wherein the plurality of faces constituting the front end constituent face of the metal shell include a first face adjoining at least a part of an inner circumferential face of the metal shell in the axial direction, said first face being an inclined face having a diameter that increases from a rear end side of the spark plug to the front end side of the spark plug in the axial direction of the spark plug, and wherein, as viewed on a cross-sectional outline of the metal shell including the axis thereof, a length of the first face is the longest of the plurality of faces constituting the front end constituent face of the metal shell.

2. The spark plug according to claim 1, wherein the insulator includes: a cylindrical portion having a uniform outer diameter in the front end portion of the insulator; and an outer diameter transition part connected to the cylindrical portion at the rear end side with respect to the cylindrical portion in the axial direction and having an outer diameter that enlarges from the front end side of the spark plug toward the rear end side of the spark plug, and wherein a second border is positioned at the front end side with respect to a first border in the axial direction, where the first border serves as a border between the cylindrical portion of the insulator and the outer diameter transition part in the axial direction, and the second border serves as a border between the inner circumferential face of the metal shell and the first face of the metal shell.

3. The spark plug according to claim 1, wherein the virtual sphere is in contact with the inner face of the bending portion at the front end side with respect to at least any one of the plurality of faces constituting the front end constituent face of the metal shell in the axial direction in the state that the virtual sphere is neither in contact with the center electrode nor the insulator.

4. The spark plug according to claim 1, wherein a relationship:

120 degrees<=α<=150 degrees, is satisfied, where "α" is an angle formed by the inner circumferential face of the metal shell and the first face of the metal shell, as viewed on a cross-sectional outline of the metal shell including the axis thereof.

5. The spark plug according to claim 1, wherein the plurality of faces of the front end constituent face include a second face comprised of a face perpendicular to the axis of the metal shell or an inclined face having a diameter that decreases from the rear end side of the spark plug to the front end side of the spark plug in the axial direction of the spark plug.

6. A method for manufacturing the spark plug comprising:

a center electrode extending in an axial direction;

an insulator having an axial bore extending in the axial direction and holding the center electrode in the axial bore at a front end side;

a cylindrical metal shell radially surrounding the insulator so as to hold the insulator and having a front end constituent face at a front end side opening thereof, wherein the front end constituent face is comprised of a visible external surface as viewed from a front end side in the axial direction of the spark plug, and has a plurality of faces; and a ground electrode having (a) one end joined to at least one of the plurality of faces constituting the front end constituent face and (b) an other end bent toward an inner circumferential of the metal shell so as to form a spark discharge gap with a front end portion of the center electrode, the ground electrode further comprising (i) an extending portion extending in the axial direction from the one end to the other end and (ii) a bending portion between the extending portion and the other end, wherein a virtual sphere having a radius of 1.2 mm is neither in contact with the center electrode nor the insulator, and is assumed to be in contact with an inner face of the bending portion of the ground electrode that faces toward the center electrode, wherein the plurality of faces constituting the front end constituent face of the metal shell include a first face adjoining at least a part of an inner circumferential face of the metal shell in the axial direction, said first face being an inclined face having a diameter that increases from a rear end side of the spark plug to the front end side of the spark plug in the axial direction of the spark plug, and wherein, as viewed on a cross-sectional outline of the metal shell including the axis thereof, a length of the first face is the longest of the plurality of faces constituting the front end constituent face of the metal shell, said method comprising:

an inclined face formation step for forming the front end constituent face, said inclined face formation step including chamfering in a circumferential direction at least a part of an end face of a front end side opening of a cylindrical metal shell intermediate body that serves as an original form of the metal shell, the first face formed by said chamfering having a diameter that is enlarged toward the front end side from the rear end side in the axial direction of the spark plug, and a second face formed on a remaining external face of the front end portion of the metal shell intermediate body which is not chamfered;

a joint face formation step for forming a first joint face and a second joint face that are to be joined together with the first face and the second face of the metal shell, respectively, in an end face of the one end of the ground electrode;

an electrode joining step for joining the one end of the ground electrode to the front end constituent face of the metal shell intermediate body while the extending portion of the ground electrode extends along the axial direction of the cylindrical metal shell intermediate body that serves as an original form of the metal shell; and a gap formation step for forming a spark discharge gap between the other end of the ground electrode and the front end portion of the center electrode by orientating the other end of the ground electrode toward the front end portion of the center electrode.

7. A method for manufacturing the spark plug comprising:

a center electrode extending in an axial direction;

an insulator having an axial bore extending in the axial direction and holding the center electrode in the axial bore at a front end side;

a cylindrical metal shell radially surrounding the insulator so as to hold the insulator and having a front end constituent face at a front end side opening thereof, wherein the front end constituent face is comprised of a visible external surface as viewed from a front end side in the axial direction of the spark plug, and has a plurality of faces; and a ground electrode having (a) one end joined to at least one of the plurality of faces constituting the front end constituent face and (b) an other end bent toward an inner circumferential of the metal shell so as to form a discharge gap with a front end portion of the center electrode, the ground electrode further comprising (i) an extending portion extending in the axial direction from the one end to the other end and (ii) a bending portion between the extending portion and the other end, wherein a virtual sphere having a radius of 1.2 mm is neither in contact with the center electrode nor the insulator, and is assumed to be in contact with an inner face of the bending portion of the ground electrode that faces toward the center electrode, wherein the plurality of faces constituting the front end constituent face of the metal shell include a first face adjoining at least a part of an inner circumferential face of the metal shell in the axial direction, said first face being an inclined face having a diameter that increases from a rear end side of the spark plug to the front end side of the spark plug in the axial direction of the spark plug, and wherein, as viewed on a cross-sectional outline of the metal shell including the axis thereof, a length of the first face is the longest of the plurality of faces constituting the front end constituent face of the metal shell, said method comprising:

an electrode joining step for joining the one end of the ground electrode to an end face of a front end side opening of a cylindrical metal shell intermediate body that serves as an original form of the metal shell, while the extending portion of the ground electrode extends along the axial direction of the cylindrical metal shell intermediate body;

an inclined face formation step for forming the first face having a diameter that increases from the rear end side to the front end side in the axial direction, said inclined face formation step including chamfering, in the circumferential direction, at least a part of the end face of the front end side opening of the cylindrical metal shell intermediate body where the ground electrode is to be joined while avoiding a joint portion with the ground electrode; and, a gap formation step for forming a spark discharge gap between the other end of the ground electrode and the front end portion of the center electrode by orientating the other end of the ground electrode toward the front end portion of the center electrode.

* * * * *